US009234678B1

(12) United States Patent
Boros et al.

(10) Patent No.: US 9,234,678 B1
(45) Date of Patent: Jan. 12, 2016

(54) STACKABLE WATER HEATER APPARATUS

(75) Inventors: Jozef Boros, Montgomery, AL (US); Hector Donastorg, Waverly, AL (US); Raheel A. Chaudhry, Montgomery, AL (US)

(73) Assignee: RHEEM MANUFACTURING COMPANY, Atlanta, GA (US)

( * ) Notice: Subject to any disclaimer, the term of this patent is extended or adjusted under 35 U.S.C. 154(b) by 275 days.

(21) Appl. No.: 13/527,061

(22) Filed: Jun. 19, 2012

Related U.S. Application Data

(60) Provisional application No. 61/539,565, filed on Sep. 27, 2011.

(51) Int. Cl.

| | |
|---|---|
| ***F24H 1/18*** | (2006.01) |
| ***F24H 9/20*** | (2006.01) |
| ***H05B 1/02*** | (2006.01) |
| ***F24D 17/00*** | (2006.01) |

(52) U.S. Cl.
CPC ..... *F24H 9/2021* (2013.01); *F24D 17/00* (2013.01)

(58) Field of Classification Search
CPC ..... F24H 1/106; F24H 1/202; F24H 9/2021; F24H 9/2007; F24H 1/182; F24D 17/00
USPC ..... 392/386–406, 407–440, 441–464, 392/465–503, 301–338, 339–346; 122/209.1–224
See application file for complete search history.

(56) References Cited

U.S. PATENT DOCUMENTS

| | | | | | |
|---|---|---|---|---|---|
| 2,157,910 | A | | 5/1939 | McCormick | |
| 2,380,545 | A | * | 7/1945 | Pankow | 392/454 |
| 2,521,207 | A | * | 9/1950 | Eaton et al. | 422/109 |
| 2,814,279 | A | * | 11/1957 | Thomas | 122/14.22 |
| 2,834,865 | A | * | 5/1958 | Coates | 392/450 |
| 2,876,472 | A | * | 3/1959 | Rousseau | 15/53.2 |
| 3,175,075 | A | * | 3/1965 | Nord et al. | 392/484 |
| 2,987,604 | A | | 6/1966 | Swoyer | |
| 3,275,802 | A | * | 9/1966 | Vandivere et al. | 219/499 |
| 3,280,299 | A | | 10/1966 | Doniak | |
| 3,440,397 | A | * | 4/1969 | Neer et al. | 219/209 |
| 3,666,918 | A | * | 5/1972 | Clark et al. | 392/452 |
| 3,766,358 | A | * | 10/1973 | Gass-Erb | 392/498 |
| 3,933,272 | A | * | 1/1976 | Lamb et al. | 222/1 |
| 3,992,607 | A | * | 11/1976 | Jolin | 392/449 |
| 4,111,798 | A | * | 9/1978 | Peterson et al. | 209/172.5 |
| 4,140,104 | A | * | 2/1979 | Itagaki | 126/374.1 |

(Continued)

FOREIGN PATENT DOCUMENTS

| | | | |
|---|---|---|---|
| GB | 2376270 | A * | 12/2002 |
| GB | 2456881 | | 8/2009 |

(Continued)

*Primary Examiner* — David Angwin
*Assistant Examiner* — Gyounghyun Bae
(74) *Attorney, Agent, or Firm* — Haynes & Boone, LLP

(57) ABSTRACT

Water heater apparatus is provided with features that allow for a horizontally compact water heater installation comprising upper and lower vertically stacked electric individual water heaters served by a single electrical branch circuit. Each of the upper and lower water heaters has a water storage capacity not exceeding 55 gallons, and the combined water storage capacity of the upper and lower water heaters is greater than 55 gallons. The electric heating elements of the two water heaters are non-simultaneously controlled so that at no time do the two water heaters heat water at the same time.

19 Claims, 5 Drawing Sheets

(56) References Cited

U.S. PATENT DOCUMENTS

| | | | | | |
|---|---|---|---|---|---|
| 4,207,866 | A | * | 6/1980 | Boyd | 126/588 |
| 4,324,207 | A | * | 4/1982 | Leuthard | 122/14.22 |
| 4,438,728 | A | * | 3/1984 | Fracaro | 122/18.31 |
| 4,534,321 | A | * | 8/1985 | Rydborn | 122/448.3 |
| 4,550,710 | A | | 11/1985 | McDonald, II | |
| 4,604,516 | A | * | 8/1986 | Metz | 392/488 |
| 4,681,257 | A | | 7/1987 | Turner | |
| 4,740,673 | A | | 4/1988 | Robinson, Jr. | |
| 4,914,275 | A | * | 4/1990 | Kramer | 392/401 |
| 5,023,926 | A | * | 6/1991 | Arnold | 392/402 |
| 5,317,670 | A | * | 5/1994 | Elia | 392/464 |
| 5,417,329 | A | * | 5/1995 | Whitman | 206/499 |
| 5,438,914 | A | | 8/1995 | Hohn et al. | |
| 5,628,401 | A | * | 5/1997 | Broeders | 206/509 |
| 5,773,797 | A | * | 6/1998 | Uemura | 219/628 |
| 5,848,222 | A | * | 12/1998 | Jung | 392/441 |
| 5,855,163 | A | * | 1/1999 | DeMars | 219/448.17 |
| 5,957,557 | A | | 9/1999 | Langer et al. | |
| 6,271,505 | B1 | | 8/2001 | Henderson | |
| 6,275,655 | B1 | * | 8/2001 | Rixen | 392/496 |
| 6,280,688 | B1 | * | 8/2001 | Motz | 422/68.1 |
| 6,938,581 | B2 | | 9/2005 | Neeser et al. | |
| 8,366,014 | B2 | * | 2/2013 | Ene et al. | 237/19 |
| 8,463,117 | B2 | * | 6/2013 | Yeung | 392/491 |
| 2002/0186965 | A1 | * | 12/2002 | Zimmer | 392/397 |
| 2004/0079749 | A1 | * | 4/2004 | Young et al. | 219/486 |
| 2006/0010937 | A1 | | 1/2006 | Kim | |
| 2007/0251468 | A1 | * | 11/2007 | Houle | 122/19.2 |
| 2008/0308709 | A1 | | 12/2008 | Tartan et al. | |
| 2010/0021149 | A1 | | 1/2010 | Mulder et al. | |
| 2010/0253082 | A1 | * | 10/2010 | Cotto-Rodriguez | 290/54 |
| 2010/0290763 | A1 | * | 11/2010 | Boulay et al. | 392/451 |

FOREIGN PATENT DOCUMENTS

| | | | |
|---|---|---|---|
| GB | 2458826 | | 10/2009 |
| JP | 2004176992 | | 6/2004 |
| JP | 2007-218521 | | 8/2007 |
| WO | WO2009079791 | A1 | 7/2009 |

* cited by examiner

STACKABLE WATER HEATER APPARATUS

CROSS-REFERENCE TO RELATED APPLICATION

The present application claims the benefit of the filing date of provisional U.S. patent application Ser. No. 61/539,565 filed Sep. 27, 2011. The entire disclosure of the provisional application is incorporated herein by this reference.

BACKGROUND OF THE INVENTION

The challenge of designing an energy efficient, economical residential electrical water heating system which effectively utilizes available building floor space has been heightened by the U.S. Department of Energy's recent amendment of their existing energy conservation standards for residential water heaters. In formulaic fashion, this amendment effectively requires that any residential water heater having a water storage capacity greater than fifty five gallons must incorporate therein a heat pump. While such incorporation is designed to increase the efficiency of an over-fifty five gallon water heater, installation with suitable airflow for all replacement applications may not be practical or cost effective. In view of this heightened efficiency requirement it would be desirable to provide multiple water heaters to meet the hot water requirements. It is to this goal that the present invention is primarily directed.

In representatively illustrated embodiments thereof, this invention provides specially designed water heater apparatus with features that allow for an installation comprising upper and lower vertically stacked electric individual water heaters served by a single electrical branch circuit. Each of the upper and lower water heaters has a water storage capacity not exceeding 55 gallons, and the combined water storage capacity of the upper and lower water heaters is greater than 55 gallons. The electric heating elements of the two water heaters are non-simultaneously controlled so that at no time do the two water heaters heat water at the same time.

DETAILED DESCRIPTION

Figure 1:
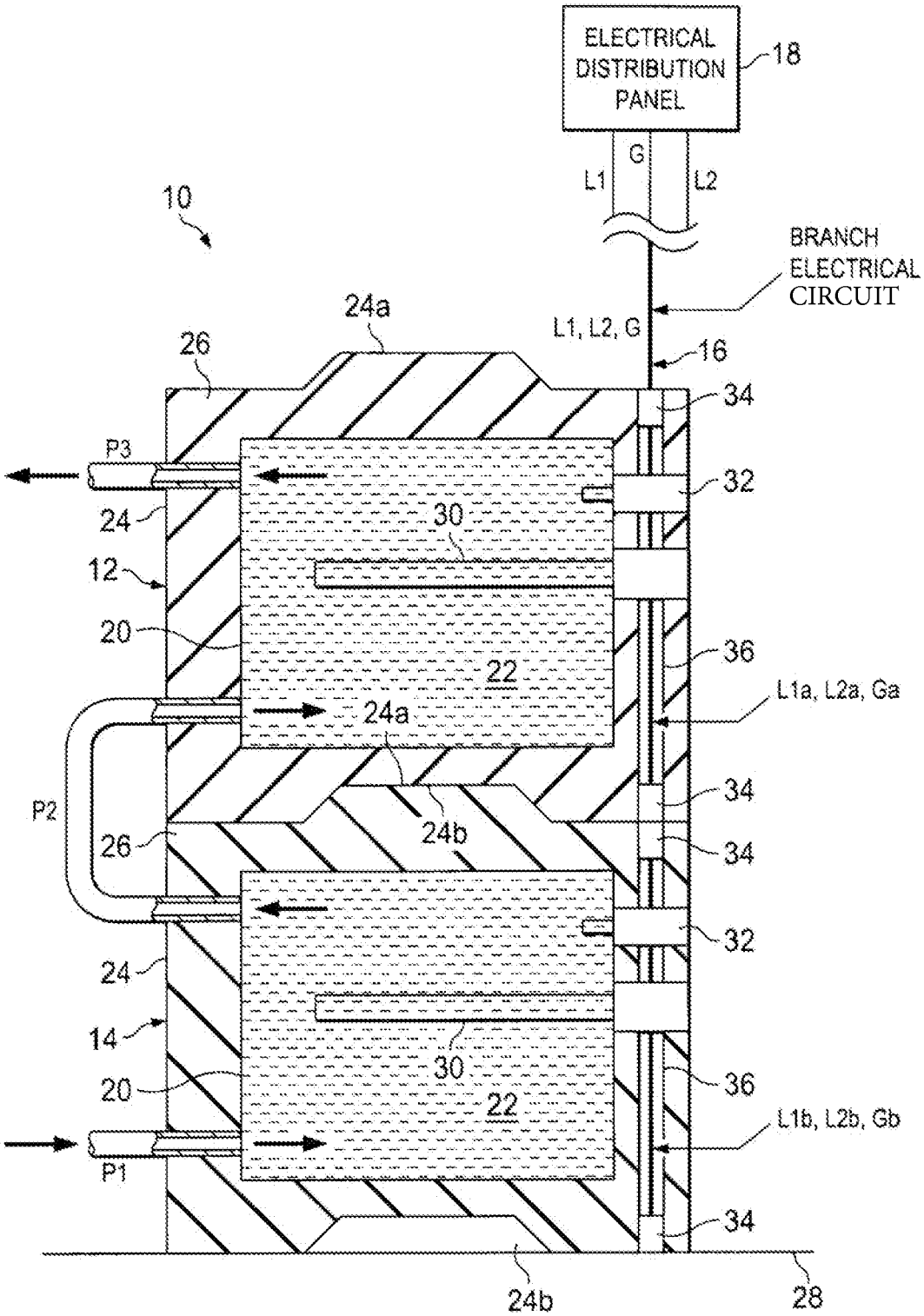
FIG. 1 is a schematic cross-sectional view through two vertically stacked electric water heaters embodying principles of the present invention and served by a single electrical branch circuit.

Schematically depicted in FIG. 1 is a specially designed electric water heater assembly 10 which comprises vertically stacked upper and lower electric water heaters 12 and 14 and is served by a single branch electrical circuit portion 16 of an electrical distribution panel 18. Branch circuit 16 comprises two power wires or leads L1 and L2, and a ground wire or lead G. Each of the water heaters 12 and 14 has a metal tank 20 adapted to hold a quantity of water 22 to be heated. According to an aspect of the present invention, the volume of each of the tanks 20 is no more than fifty five gallons, and the total volume of the two tanks 20 is greater than fifty five gallons. As subsequently described herein, the upper and lower electric water heaters 12 and 14 are non-simultaneously controlled in a manner such that neither water heater operates while the other one is performing its water heating function. Thus, the electrical branch circuit 16 need only be sized to accommodate one of the two water heaters 12 and 14 (the larger one if they do not have equal water heating capacities). Importantly, this combination of design aspects in the present invention adheres to both the letter and spirit of the DOE energy efficiency standard amendment. Specifically, neither of the water heaters has a water storage capacity exceeding fifty five gallons, and the two stored water quantities (which together exceed fifty five gallons) are never heated at the same time.

Still referring to FIG. 1, each the tanks 20 is enclosed within an outwardly spaced metal jacket 24, with suitable insulation 26 being disposed within the space between the jacket 24 and the tank 20. The upper end of each jacket 24 has a centrally disposed upward projection 24*a*, and the lower end of each jacket 24 has a complementarily shaped central recess 24*b*. The upper and lower water heaters 12 and 14 are vertically stacked as shown in FIG. 1 by placing the lower water heater 14 on a suitable horizontal support surface such as a floor 28 and then placing the upper water heater 12 atop the lower water heater 14 in a manner such that the upper projection 24*a* of the lower water heater 14 is interlockingly received in the lower recess 24*b* of the upper water heater 12. This horizontally aligns and stabilizes the upper and lower water heaters 12 and 14.

While the illustrated upper and lower water heaters 12 and 14 are representatively depicted as being identical, it will be readily apparent to those of ordinary skill in this particular art that they could be of different storage capacities, heating capacities and/or different physical sizes if desired without departing from principles of the present invention. For example, the upper water heater 12 could be of a smaller diameter than the lower water heater 14, with the central vertical axes of the two water heaters being horizontally offset from one another. It should be noted that the vertical stacking of the two water heaters 12 and 14 advantageously reduces the footprint of the overall water heater assembly 10 compared to, for example, (1) placing both of the water heaters 12,14 on the floor 28, or (2) using a single water heater (having the same total water storage and heating capacity as the stacked water heater assembly 10).

Each of the upper and lower water heaters 12 and 14 has a resistance type electrical heating element 30 horizontally extending into the interior of its tank 20 and being controlled by a conventional combination high limit/operating thermostat 32. As indicated by the flow arrows in FIG. 1, during operation of the assembly 10, water flows into the lower tank 20 via an inlet pipe P1, from the lower tank 20 into the upper tank 20 via a transfer pipe P2, and then out of the upper tank 20 through an outlet pipe P3. As will be readily appreciated by those of skill in this particular art, the plumbing connections between the two water heaters may be accomplished to provide either a serial flow connection therebetween (as illustratively depicted in FIG. 1) or a parallel flow connection between the two water heaters.

Circumferentially aligned junction boxes 34 are disposed in peripheral portions of the upper and lower ends of each of the upper and lower water heaters 12 and 14. Extending downwardly through the insulation 26 between the two junction boxes 34 on each water heater 12 and 14 is a vertical wiring passage 36. The upper water heater 12 is stacked atop the lower water heater 14 in a manner such that, as schematically depicted in FIG. 1, the junction boxes 34 and the wiring passages 36 are circumferentially aligned with one another.

Figure 2:
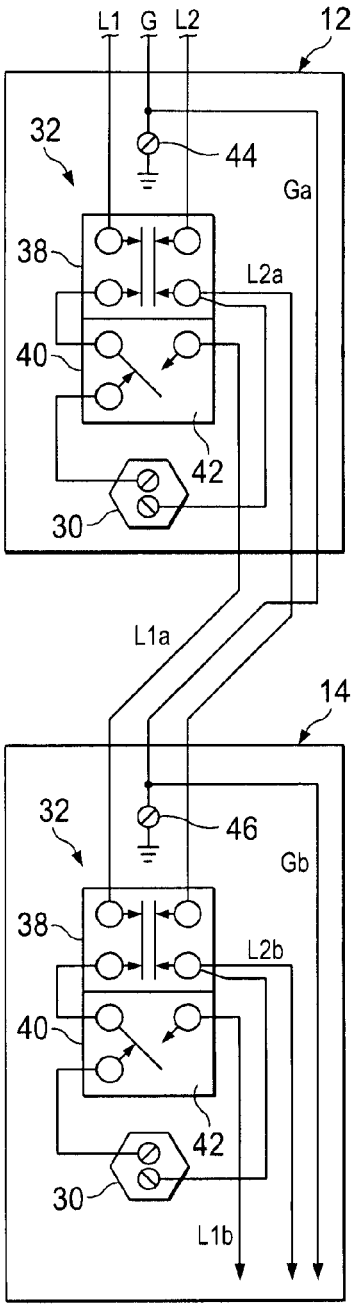
FIG. 2 is a schematic electrical circuit diagram of the stacked water heaters.

As subsequently described in more detail herein, power and ground wiring from the single branch electrical circuit 16 is passed downwardly through the circumferentially aligned wiring passages 36 and is operatively connected to the heating elements 30 and the thermostats 32 in a manner such that the heating elements are non-simultaneously controlled. With reference now to FIG. 2, each of the conventional thermostats 32 has an upper high limit section 38 and a lower operating section 40. Sections 38 and 40 have the indicated wiring terminals 1-4, and each operating section 40 is provided with the indicated single pole, double throw switch 42. Each electric heating element 30 is electrically coupled to its associated switch terminals 2 and 4 as indicated.

According to a feature of the present invention, the two thermostats 32 are electrically coupled in a manner providing the non-simultaneous control of the two heating elements 30 so that only one is operable at a given time. Specifically, as schematically depicted in FIG. 2, power leads L1 and L2 are respectively connected to terminals 1 and 3 of the high limit section 38 of the upper thermostat 32, and the ground lead G is connected to the grounding terminal 44 of the upper water heater 12. Operative control coupling of the upper and lower water heaters 12 and 14 is effected utilizing supplemental power leads L1*a*,L2*a* and a supplemental grounding lead Ga. Lead L1*a* is interconnected between the thermostat operating section terminal 4 of the upper water heater 12 and the thermostat high limit section terminal 1 of the lower water heater 14. Lead L2*a* is interconnected between the thermostat high limit section terminal 4 of the upper water heater 12 and the thermostat operating section terminal 3 of the lower water heater 14. Lead Ga is interconnected between lead G and the grounding terminal 46 of the lower water heater 14.

By tracing the circuitry in FIG. 2 it can be seen that with the upper thermostat switch 32 interconnecting its associated thermostat operating section terminals 1 and 2 current flow through the upper heating element 30 to satisfy the water heating demand of the upper water heater 12 is permitted, but simultaneous current flow through the lower heating element 30 is precluded by the circuit opening between terminals 1 and 4 of the operating section 40 of the upper thermostat 32. Conversely, when the water heating demand of the upper water heater 12 is satisfied, the upper switch 32 disconnects the terminals 1 and 2 of the operating section 40 of the upper thermostat 32 and electrically connects the terminals 1 and 4 of the operating section 40 of the upper thermostat 32, thereby permitting current flow through the lower heating element 30 and blocking current flow through the upper heating element 30. Accordingly, neither heating element 30 can receive a current throughflow when the other heating element 30 has electrical current being supplied thereto.

Representatively, but not by way of limitation, the water heaters schematically depicted in FIGS. 1 and 2 are of substantially identical size and construction, with the lower water heater 14 having capped-off power and ground leads L1*b*, L2*b* and Gb connected as shown to its heating element 30 and thermostat 40. As will be appreciated, these leads may be operatively connected to the thermostat and heating element of another water heater upon which the water heater 14 is to be stacked. Water heater 12 would, as manufactured, also have these capped off leads which may be operatively coupled to a water heater upon which it could be stacked. In the stacked water heater assembly shown in FIGS. 1 and 2, the lead sets L1, L2 and G, L1*a*, L2*a* and Ga, and L1*b*, L2*b* and Gb may be conveniently run downwardly through the aligned wiring passages 36 as shown in FIG. 1.

Figure 3:
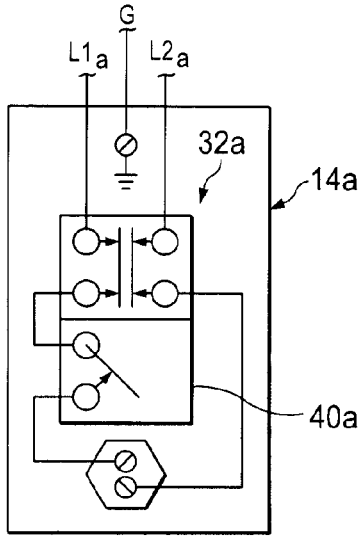
FIG. 3 is a schematic electrical circuit diagram of a single element electric water heater useable in place of the lower water heater in FIG. 1.

An alternate bottom electric water heater embodiment 14*a* is shown in FIG. 3. Water heater 14*a* is identical in construction to the previously described water heater 14 with the exceptions that it is not provided with the bottom interconnecting leads L1*b*, L2*b* and Gb, and its thermostat 32*a* does not utilize a terminal 4 on its operating section 40*a*.

Figure 4:
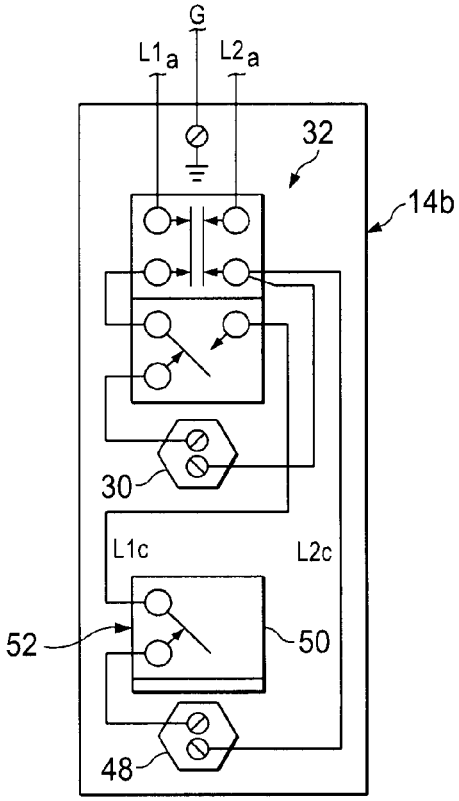
FIG. 4 is a schematic electrical circuit diagram of a double element electric heater useable in place of the lower water heater in FIG. 1.

A second alternate bottom electric water heater embodiment 14*b* is shown in FIG. 4. Water heater 14*b* has upper and lower electric heating elements 30 and 48 which are respectively controlled by a conventional combination high limit/operating thermostat 32 and a thermostat 50 having a single pole single throw switch 52. The upper thermostat 32 and heating element 30 are operatively interconnected as shown by power leads L1*c* and L2*c*, and the upper thermostat 32 is connected to the thermostat 32 of the upper water heater 12 (see FIG. 2) by the leads L1*a*, L2*a* and Ga. As can be seen this wiring connection provides non-simultaneous control of the water heaters 12 and 14*b*, and further prevents non-simultaneous operation of the heating elements 32 and 48 in the lower water heater 14*b*.

Figure 5:
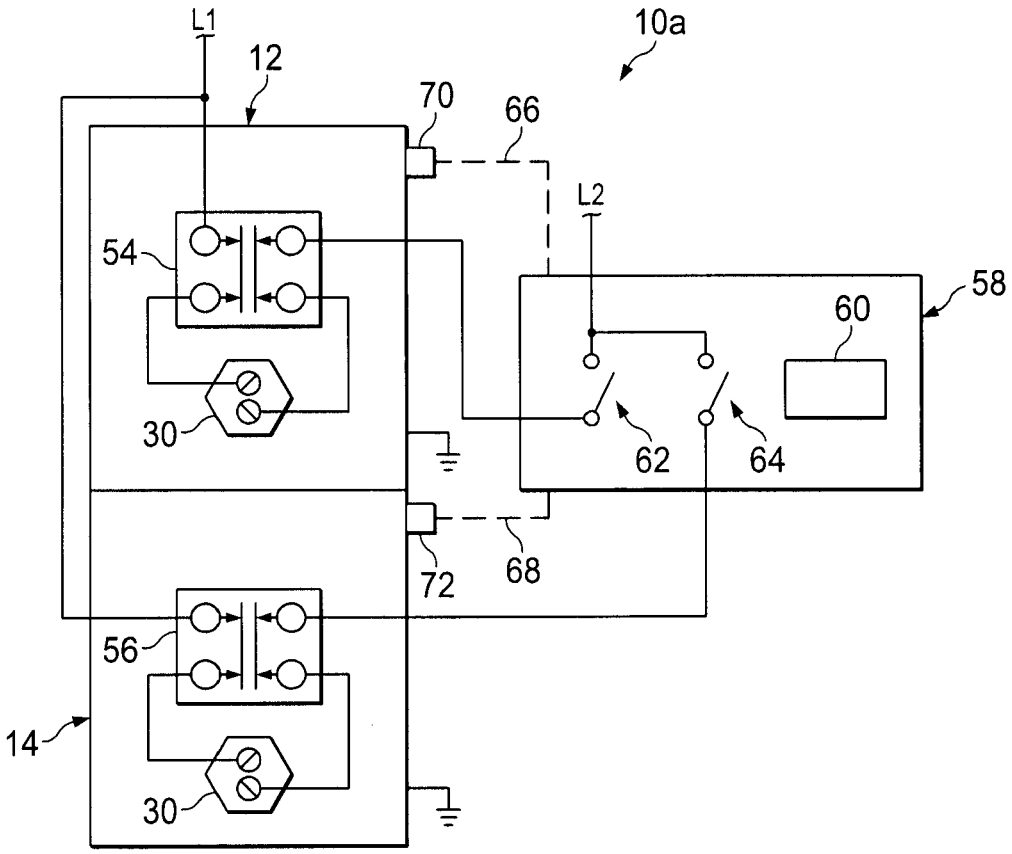
FIG. 5 is a schematic electrical circuit diagram of first and second vertically stacked single element electric water heaters which are electronically controlled and served by a single electrical branch circuit.

Schematically illustrated in FIG. 5 is an alternate embodiment 10*a* of the previously described stacked water heater assembly 10. In assembly 10*a* the previously described combination high limit/operating thermostats 32 shown in FIG. 1 are replaced by high limit switch structures 54 and 56 respectively disposed within the tank portions of the upper and lower water heaters 12 and 14, and the switching capability useable to provide non-simultaneous control of the upper and lower water heaters 12 and 14 is provided by an electronic control panel 58 incorporating therein a suitable preprogrammed microprocessor 60. Power lead L1 is connected to the upper and lower high limits switches 56, and the heating elements 30 are also connected as shown to the high limit switches 54 and 56. Further, the high limit switches 54 and 56 are respectively connected as illustrated to two control panel switches 62 and 64 which are also electrically connected as shown to the power lead L2. Switches 62 and 64 may alternatively be relays, or other electronic devices, that can switch the resistive load of the heating elements. In response to temperature signals 66 and 68 respectively received from upper and lower tank water temperature sensors 70 and 72, the control panel 58 electronically controls the switches 62 and 64 in a manner providing non-simultaneous control of the upper and lower water heaters 12 and 14 shown in FIG. 5.

Figure 6:
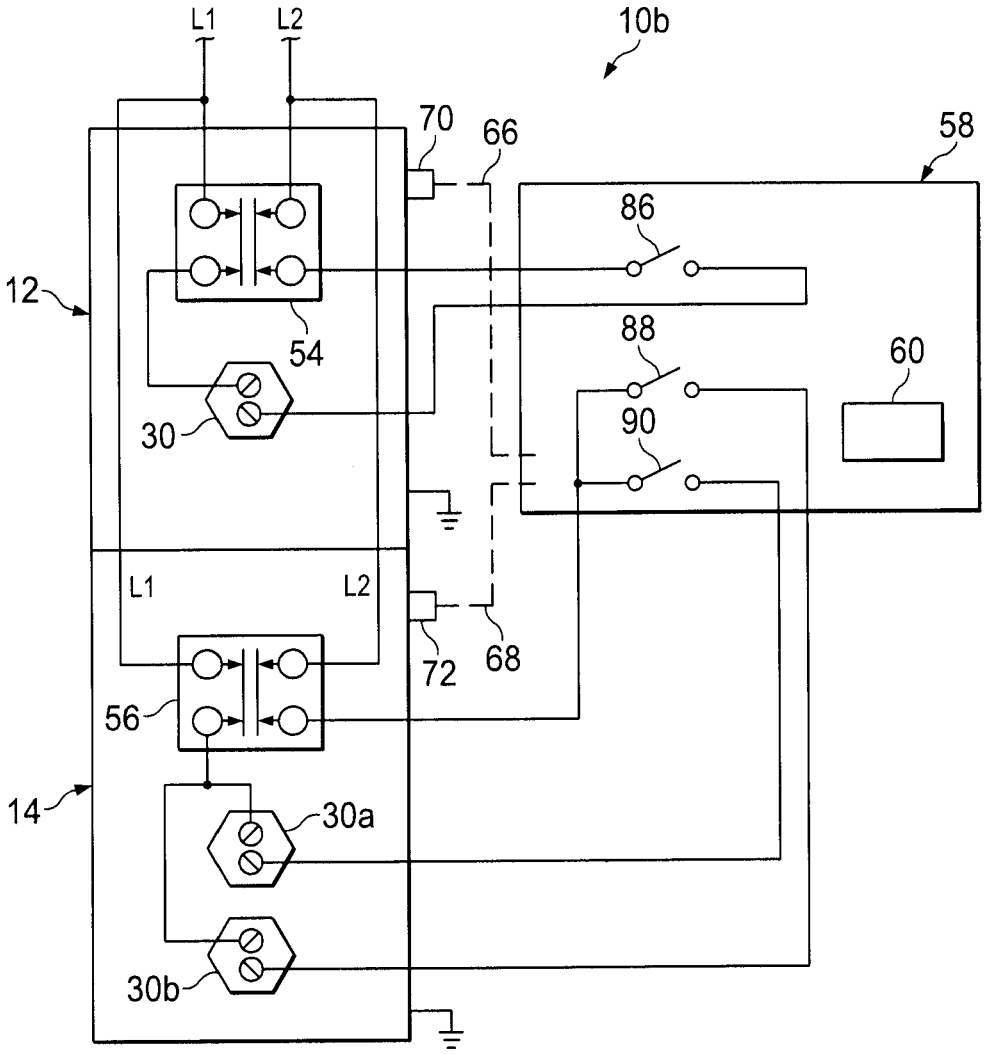
FIG. 6 is a schematic electrical circuit diagram of vertically stacked single element and double element electric water heaters which are electronically controlled and served by a single electrical branch circuit.

A second alternate embodiment 10*b* of the water heater assembly 10 is schematically shown in FIG. 6 and is substantially identical to the previously described assembly 10*a* in FIG. 5 with the primary exceptions that the lower water heater 14 is provided with upper and lower heating elements 30*a* and 30*b* coupled to their associated high limit switch 56 as shown, and three switches 86, 88 and 90 are included in the control panel 58 and coupled to the high limit switches 54,56 and the electric heating elements 30, 30*a* and 30*b* as shown. Switches 86,88 and 90 may alternatively be relays, or other electronic devices, that can switch the resistive load of the heating elements. In response to temperature signals 66 and 68 respectively received from upper and lower tank water temperature sensors 70 and 72, the control panel 58 electronically controls the switches 86, 88 and 90 in a manner providing non-simultaneous control of the upper and lower water heaters 12 and 14, and further providing non-simultaneous energization of the lower water heater heating elements 30*a* and 30*b*.

Figure 7:
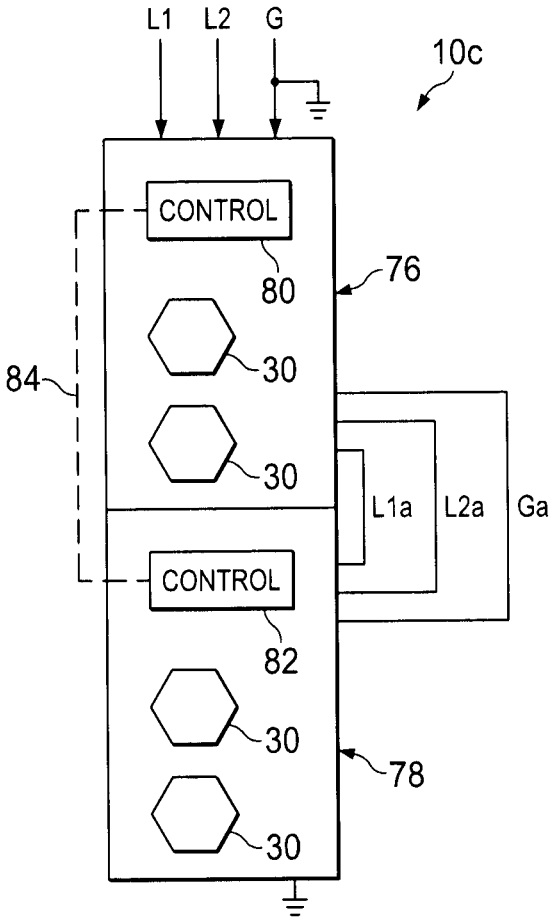
FIG. 7 schematically depicts an alternative electronic control scheme for vertically stacked water heaters that are served by a single electrical branch circuit.

Shown in FIG. 7 is a third alternate embodiment 10*c* of the previously described stacked water heater assembly 10. Embodiment 10*c*, by way of non-limiting example, comprises vertically stacked upper and lower water heaters 76 and 78 electrically coupled by the previously described lead sets L1, L2 and G, and L1*a*, L2*a* and Ga, and each having dual electrical resistance heaters 30 extending through the interiors of their tank portions. The upper and lower water heaters 76 and 78 are non-simultaneously controlled by upper and lower control structures 80 and 82 which may communicate with one another via a communication line 84. Representatively, the upper control structure 80 may be a master unit, and the lower control structure 82 may be a slave unit, with the master unit 80 having the capability of sensing whether the upper and lower water heaters 76 and 78 have single or multiple heating elements and responsively adjusting the control functions and sequences associated with the operative control of the upper and lower water heaters 76 and 78. Master unit 80 also determines which element to turn on in a way that only one element is turned on at any given time.

The foregoing detailed description is to be clearly understood as being given by way of illustration and example only, the spirit and scope of the present invention being limited solely by the appended claims.

What is claimed is:

1. Electric water heating apparatus comprising first and second electric water heaters each having a tank adapted to hold a quantity of water to be heated, thermal insulation arranged to insulate a portion of said tank, an electric heating structure for heating water disposed in said tank, an electrical control circuit for controlling said electric heating structure, and electrical wiring, the electrical control circuits of the first and second water heaters and the electrical wiring forming a control unit, wherein the control unit is arranged to the electric heating structure of the second electric water heater to be powered only if the electric heating structure of the first electric water heater is not powered, said first and second electric water heaters being in a vertically stacked end-to-end relationship in which top and bottom ends of said first and second electric water heaters, respectively, are interfittingly interlocked with one another, wherein the first and second water heaters comprise junction boxes and a vertical wiring passage extending between the junction boxes and through the thermal insulation, the vertical wiring passage containing the electrical wiring, the junction boxes being arranged to be vertically aligned when the first and second water heaters are interfittingly interlocked with one another to electrically connect said electric wiring of said first and second electric water heaters.

2. The electric water heater apparatus of claim 1 wherein:

said first and second electric water heaters have identical configurations.

3. The electric water heater apparatus of claim 1 wherein:

each of said first and second electric water heaters has a projection on its top end and a recess in its bottom end, with the projection of one of said first and second electric water heaters being complementarily received in the recess of the other one of said first and second electric water heaters.

4. The electric water heater apparatus of claim 3 wherein:

said projections and recesses are centrally disposed respectively on said top and bottom ends of said first and second electric water heaters.

5. The electric water heater apparatus of claim 4 wherein:

said projections and recesses have frustroconical configurations.

6. The electric water heater apparatus of claim 1 wherein:

neither of said first and second tanks has a volume exceeding fifty five gallons, and the total volume of said first and second tanks exceeds fifty five gallons.

7. The electric water heater apparatus of claim 1 wherein each of said first and second electric water heaters has:

a jacket structure outwardly circumscribing its tank and forming an insulation space between its jacket structure and its tank;

an insulation material disposed in said insulation space;

upper and lower electrical junction boxes respectively disposed on its top and bottom ends; and a wiring passage extending through said insulation material between said upper and lower electrical junction boxes.

8. Electric water heating apparatus comprising a plurality of electric water heaters having top and bottom ends configured to permit said plurality of electric water heaters to be vertically stacked in an end-to-end relationship in which each facing pair of said top and bottom ends interfittingly interlock with one another, each of said plurality of electric water heaters having thermal insulation arranged to insulate a portion of said tank, an electric heating structure and an electric control circuit for controlling said electric heating structure, wherein said electrical control circuits are interconnectable such that the electric heating structure of a first electric water heater of the plurality of electric water heaters is to be powered only if the electric heating structure of a second electric water heater of the plurality of water heaters is not powered;

Wherein the plurality of water heaters comprise junction boxes and a vertical wiring passage extending between the junction boxes and through the thermal insulation, the vertical wiring passage containing the electrical wiring, the junction boxes being arranged to be vertically aligned when the first and second water heaters are interfittingly interlocked with one another to electrically connect said electric wiring.

9. The electric water heating apparatus of claim 8 wherein:

the electric water heaters in said plurality thereof have identical configurations.

10. The electric water heating apparatus of claim 8 wherein:

each of said plurality of electric water heaters has a projection on its top end and a recess on its bottom end, and when said plurality of electric water heaters are vertically stacked in an end-to-end relationship, the projections and recesses in each facing pair of said top and bottom ends are configured to be complementarily telescoped with one another.

11. The electric water heating apparatus of claim 10 wherein:

said projections and recesses are centrally disposed respectively on said top and bottom ends of said plurality of electric water heaters.

12. The electric water heating apparatus of claim 10 wherein:

said projections and recesses have frustroconical configurations.

13. The electric water heating apparatus of claim 8 wherein:

each of said plurality of electric water heaters has a tank for holding water to be heated, none of said tanks of said plurality of electric water heaters has a volume exceeding fifty five gallons, and the total tank volume of said electric water heating apparatus exceeds fifty five gallons.

14. The electric water heating apparatus of claim 8 wherein each of said plurality of electric water heaters further comprises:

a tank adapted to hold a quantity of water to be heated;

a jacket structure outwardly circumscribing said tank and forming an insulation space between said jacket structure and the tank;

an insulation material disposed in said insulation space;

upper and lower electrical junction boxes respectively disposed on said top and bottom ends of the electric water heater, and a wiring passage extending through said insulation material between said upper and lower electrical junction boxes.

15. A water heating apparatus comprising:

a first water heater having:

a first thermal insulation;

a first tank;

a first junction box;

a first electric heating structure; and a first control unit connected to the first electric heating structure;

a second water heater having:

a second thermal insulation;

a second tank;

a second junction box;

a second electric heating structure; and a second control unit connected to the first electric heating structure; and electrical wiring interconnecting the first control unit and the second control unit, said electrical wiring extending through a vertical wiring passage through the first thermal insulation and the second thermal insulation, between said first junction box and said second junction box are vertically aligned when the first and second water heaters are interfittingly interlocked with one another to electrically connect said electric wiring;

wherein the first control unit, second control unit, and electrical wiring are arranged such that the second electric heating structure is to be powered only if the first electric heating structure is not powered.

16. The water heating apparatus of claim 15, wherein the first control unit, second control unit, and electrical wiring are further arranged such that the second electric heating structure cannot be powered while the first electric heating structure is powered.

17. The water heating apparatus of claim 15, wherein the first tank comprises an upper end, a lower end, a projection extending upwardly from said upper end, and a recess formed in said lower end and having a configuration complementary to that of said projection.

18. The water heating apparatus of claim 17 wherein:

said projection and said recess have frustroconical configurations.

19. The water heating apparatus of claim 17 wherein:

said projection and said recess are centrally positioned respectively on said top and bottom ends of said electric water heater.

* * * * *